US010331066B2

(12) United States Patent
Tamaki

(10) Patent No.: US 10,331,066 B2
(45) Date of Patent: Jun. 25, 2019

(54) IMAGE FORMING DEVICE

(71) Applicant: KYOCERA Document Solutions Inc., Osaka-shi (JP)

(72) Inventor: Kenichi Tamaki, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/973,571

(22) Filed: May 8, 2018

(65) Prior Publication Data

US 2018/0329344 A1 Nov. 15, 2018

(30) Foreign Application Priority Data

May 15, 2017 (JP) ..... 2017-096406

(51) Int. Cl.
*G03G 15/00* (2006.01)
*G03G 15/08* (2006.01)

(52) U.S. Cl.
CPC ..... *G03G 15/50* (2013.01); *G03G 15/0856* (2013.01); *G03G 15/0877* (2013.01); *G03G 15/0893* (2013.01); *G03G 15/556* (2013.01); *G03G 15/0889* (2013.01)

(58) Field of Classification Search
CPC ..... G03G 15/081; G03G 15/0856; G03G 15/0858; G03G 15/086; G03G 15/0862; G03G 15/0877; G03G 15/0879; G03G 15/0887–0893; G03G 15/50
See application file for complete search history.

(56) References Cited

U.S. PATENT DOCUMENTS

| | | | | |
|---|---|---|---|---|
| 9,454,105 | B1 * | 9/2016 | Onishi | G03G 15/0935 |
| 2014/0140733 | A1 * | 5/2014 | Shimizu | G03G 15/0877 399/254 |
| 2015/0205225 | A1 * | 7/2015 | Konishi | G03G 15/0868 399/262 |
| 2016/0033895 | A1 * | 2/2016 | Noda | G03G 15/0853 399/12 |

FOREIGN PATENT DOCUMENTS

JP 2005-346116 12/2005

* cited by examiner

*Primary Examiner* — Carla J Therrien
(74) *Attorney, Agent, or Firm* — Gerald E. Hespos; Michael J. Porco; Matthew T. Hespos

(57) ABSTRACT

In an image forming device including a volume supply type developing device, generation of an aggregate of a developer on a back surface of a layer thickness regulating member is suppressed, while occurrence of an image failure caused by the aggregate is suppressed. An image forming device includes: a photosensitive drum; a developing device including a developing roller; a toner container including a toner sensor; and a control portion. According to an increase or decrease of a retention part formed in a first transport path, a toner flows into the developing device from the toner container. The control portion causes the developing roller to reversely rotate at predetermined timing when the toner sensor senses that a residual amount of a toner in the toner container falls below a predetermined threshold value.

8 Claims, 5 Drawing Sheets

IMAGE FORMING DEVICE

The present application claims priority from Japanese Patent Application No. 2017-096406 filed on May 15, 2017, the entire contents of which are hereby incorporated by reference.

BACKGROUND

The present disclosure relates to an image forming device including a developing device.

A known conventional image forming device which forms an image on a sheet includes an image carrier, a developing device, and a developer container. When a developer is supplied from the developing device to the image carrier, an electrostatic latent image formed on the image carrier appears as a developer image. The developer container includes a developer discharge port and supplies a replenishment developer to a developer replenishing port provided in the developing device.

A volume supply type developing device is also known. The developing device includes a developing housing, a developing roller, a developer transport member, and a layer thickness regulating member. The developer transport member is rotated in the developing housing to transport and stir a developer. Arrangement of the layer thickness regulating member so as to be opposed to the developing roller regulates an amount of a developer to be carried on the developing roller.

Additionally, in the developing housing, the above developer replenishing port is opened above the developer transport member. In the developer transport member, a transport capacity suppressing portion which partly suppresses a transport capacity is formed downstream of the developer replenishing port. As a result, a developer retention part is formed around the developer replenishing port. When the amount of the developer in the developing housing is increased, the retention part seals the developer replenishing port, so that an inflow of a replenishment developer from the developer container to the developing housing is regulated. On the other hand, when the amount of the developer in the developing housing is reduced, a gap is formed between the retention part and the developer replenishing port, so that the replenishment developer flows into the developing housing from the developer container.

SUMMARY

An image forming device according to one aspect of the present disclosure includes a developer container; a developing device; a photosensitive drum; a transfer portion; a residual amount sensing portion; a driving portion; and a drive control portion. The developer container houses a developer therein and has a developer discharge port capable of discharging the developer. The developing device has a developing roller configured to be rotatable and carrying a developer on a circumference surface of the developing roller, and receives the developer from the developer container. The photosensitive drum has a surface on which an electrostatic latent image is formed, and carries a developer image made to appear from the electrostatic latent image by the developer on the developing roller. The transfer portion transfers the developer image on the photosensitive drum to a sheet. The residual amount sensing portion senses that a residual amount of a developer in the developer container falls below a predetermined threshold value. The driving portion generates a driving force to cause the developing roller to rotate around a predetermined axis in a first rotation direction and a second rotation direction opposite to the first rotation direction. The drive control portion controls the driving portion to rotatably drive the developing roller. The developing device includes a developing housing; a developer transport path; a developer replenishing port; a first transport member; a second transport member; a transport capacity suppressing portion; and a layer thickness regulating member. The developing housing rotatably supports the developing roller. The developer transport path is formed in the developing housing and includes a first transport path which is arranged at an interval from the developing roller and in which the developer is transported in a first direction along an axis direction of the developing roller, and a second transport path which is arranged between the developing roller and the first transport path and in which the developer is transported in a second direction opposite to the first direction. The developer is circularly transported between the first transport path and the second transport path. The developer replenishing port is opened, in the housing, below the developer discharge port and above the first transport path, and receives the developer from the developer container onto the developer transport path. The first transport member is rotatably arranged on the first transport path, and is configured to transport the developer in the first direction. The second transport member is rotatably arranged on the second transport path, and is configured to transport the developer in the second direction, and to supply the developer to the developing roller. The transport capacity suppressing portion is provided downstream of the developer replenishing port in the first direction to partly suppress a transport capacity of the developer in the first direction of the first transport member, thereby forming a developer retention part at a position opposed to the developer replenishing port. The layer thickness regulating member is arranged to be opposed to the developing roller to regulate a layer thickness of the developer supplied from the second transport member to the developing roller. During developing operation in which the electrostatic latent image is made to appear by the developer on the developing roller, the drive control portion causes the developing roller to rotate in the first rotation direction and when the residual amount sensing portion senses that a residual amount of the developer in the developer container falls below the threshold value, causes the developing roller to rotate in the second rotation direction at predetermined timing.

DETAILED DESCRIPTION

Figure 1:
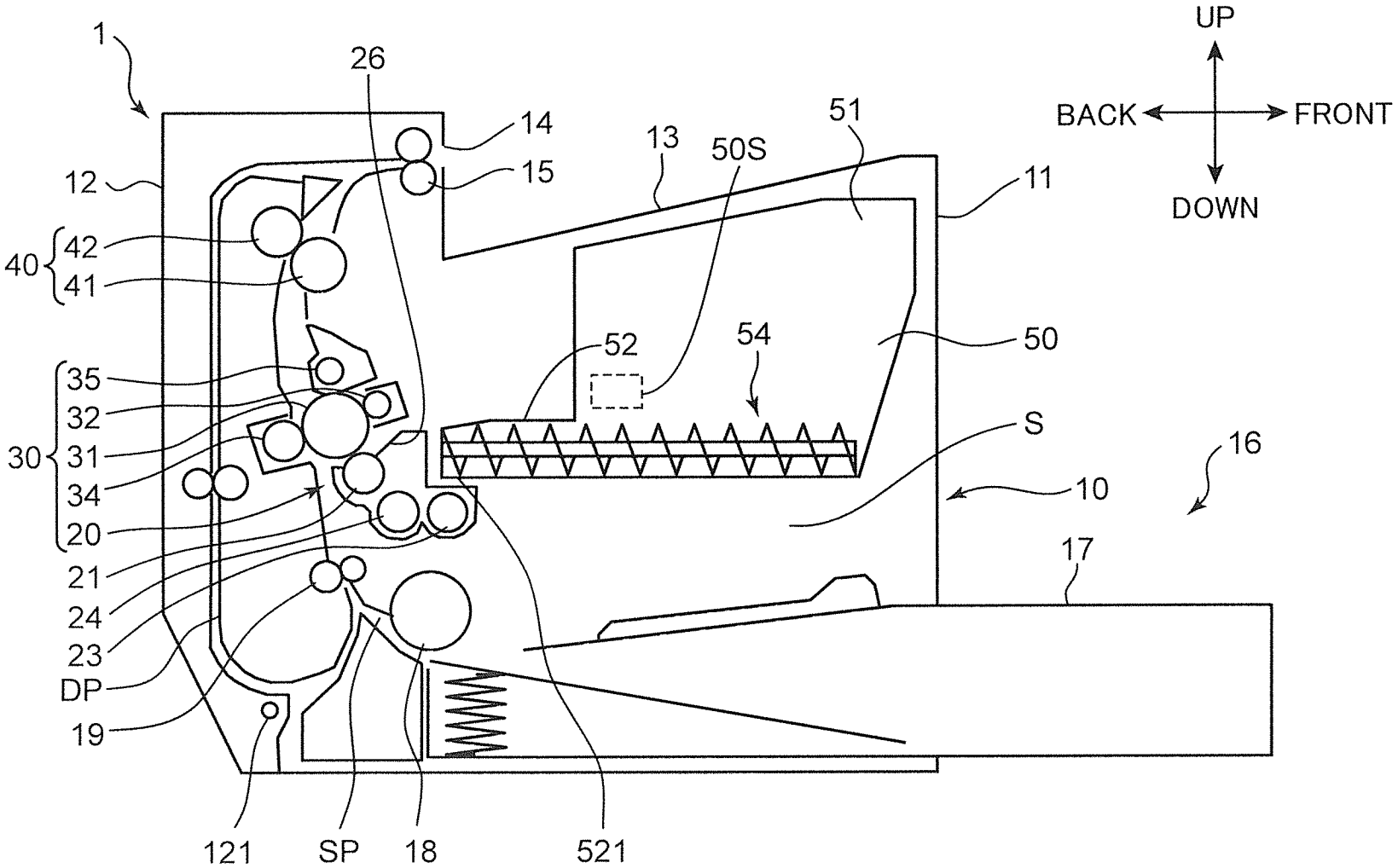
FIG. 1 is a schematic sectional view showing an internal structure of an image forming device according to one embodiment of the present disclosure.

In the following, an embodiment of the present disclosure will be detailed with reference to the accompanying drawings. FIG. 1 is a sectional side view showing an internal structure of an image forming device 1 according to one embodiment of the present disclosure. Although a monochrome printer is illustrated herein as the image forming device 1, the image forming device may be a copying machine, a facsimile machine, or a multifunctional machine equipped with these functions, or an image forming device which forms a color image.

The image forming device 1 includes a main body housing 10 having a generally rectangular solid casing structure, a sheet feeding portion 16, an image forming portion 30, a fixing portion 40, and a toner container 50 (a developer container) all housed in the main body housing 10.

The main body housing 10 is provided with a front cover 11 on a front side thereof and a back cover 12 on a back side thereof. The toner container 50 is exposed to the front side by opening the front cover 11. This allows a user to take out the toner container 50 from the front side of the main body housing 10 when a toner runs out. The back cover 12 is a cover opened at the time of sheet jam or maintenance. Each unit of the image forming portion 30 and the fixing portion 40 is allowed to be taken out from the back side of the main body housing 10 when the back cover 12 is opened. Also on an upper face of the main body housing 10, a sheet ejection portion 13 is provided to which a sheet on which an image has been formed is ejected. In an inner space S of the main body housing 10, various devices for executing image formation are installed.

The sheet feeding portion 16 includes a sheet feeding cassette 17 which houses a sheet to be subjected to image formation processing. The sheet feeding cassette 17 is provided with a sheet housing space in which a bundle of the sheets is housed, a lift plate which lifts up the bundle of sheets for sheet feeding, and the like. Above a back end side of the sheet feeding cassette 17, a sheet feeding roller 18 is arranged for dispensing an uppermost sheet of a bundle of sheets in the sheet feeding cassette 17 one by one.

The image forming portion 30 conducts the image formation processing of forming a toner image on a sheet to be sent out from the sheet feeding portion 16. The image forming portion 30 includes a photosensitive drum 31 (image carrier), a charging device 32, an exposure device (not shown in FIG. 1), a developing device 20, a transfer roller 34 (transfer portion), and a cleaning device 35, which are arranged around the photosensitive drum 31.

The photosensitive drum 31 includes a rotation shaft (not shown), and a tubular surface (circumference surface) rotating around the rotation shaft. On the tubular surface, an electrostatic latent image is formed, and a toner image (developer image) caused to appear from the electrostatic latent image by a toner (developer) on a developing roller 21 is carried by the tubular surface. As the photosensitive drum 31, a photosensitive drum using an amorphous silicon (a-Si) based material can be used.

The charging device 32 uniformly charges a surface of the photosensitive drum 31 and includes a charging roller which comes into contact with the photosensitive drum 31.

The cleaning device 35 has a cleaning blade (not shown) to clean a toner attached to the tubular surface of the photosensitive drum 31 after toner image transfer, as well as transporting the toner to a collection device (not shown).

The exposure device, which has a laser light source and an optical apparatus such as a mirror, a lens or the like, radiates, to a circumference surface of the photosensitive drum 31, light modulated on the basis of image data applied from an external device such as a personal computer, to form an electrostatic latent image.

The developing device 20 supplies a toner to the circumference surface of the photosensitive drum 31 for developing the electrostatic latent image on the photosensitive drum 31 to form a toner image. The developing device 20 includes the developing roller 21 which carries a toner on a circumference surface thereof to supply a toner to the photosensitive drum 31, a first stirring screw 23 (a first transport member) which circularly transports a developer while stirring the same, and a second stirring screw 24 (a second transport member). Also, the developing device 20 receives a replenishment toner from the toner container 50. The developing device 20 will be detailed later.

The transfer roller 34 is a roller for transferring a toner image formed on the tubular surface of the photosensitive drum 31 to a sheet. The transfer roller 34 is in contact with the tubular surface of the photosensitive drum 31 to form a transfer nip portion. The transfer roller 34 is given a transfer bias of a polarity opposite to that of a toner.

The fixing portion 40 executes fixing processing of fixing a transferred toner image on a sheet. The fixing portion 40 includes a fixing roller 41 having a heating source therein, and a pressuring roller 42 which is brought into contact with the fixing roller 41 by pressure to form a fixing nip portion with the fixing roller 41. When a sheet to which a toner image is transferred is passed through the fixing nip portion, the toner image is fixed on the sheet by heating by the fixing roller 41 and pressing by the pressuring roller 42.

The toner container 50 houses therein a toner (developer) to be replenished to the developing device 20. The toner container 50 includes a container main body 51 as a main part for storing a toner, a cylindrical portion 52 provided to project from a lower part on one side surface of the container main body 51, a rotation member 54 which transports a toner housed in the container, and a toner sensor 50S (a residual amount sensing portion). As a result of rotatable driving of the rotation member 54, the toner stored in the toner container 50 is supplied into the developing device 20 from a toner discharge port 521 (a developer discharge port) capable of discharging a toner and provided below a front end of the cylindrical portion 52. The rotation member 54 is rotatably driven in a predetermined cycle. As a result, the toner in the container main body 51 is continuously sent to the front end side of the cylindrical portion 52.

The toner sensor 50S senses a residual amount of a toner in the container main body 51 (a residual amount of a toner falling below a predetermined threshold value). In detail, the toner sensor 50S is formed with a piezoelectric element or a magnetic permeability sensor (magnetic sensor) to output a signal of +5 V (with toner) or a signal of 0 V (without toner) according to presence/absence of a toner in a region opposed to the toner sensor 50S. An output of the toner sensor 50S is referred to by a control portion 90 to be described later to sense that a residual amount of a toner in the toner container 50 is reduced.

In the main body housing 10, there are provided a main transport path SP and a reverse transport path DP for transporting a sheet. The main transport path SP extends from the sheet feeding portion 16 via the image forming portion 30 and the fixing portion 40 to a sheet ejection port 14 provided to be opposed to the sheet ejection portion 13 on the upper face of the main body housing 10. The reverse transport path DP is a transport path for returning a single-side printed sheet to an upstream side, on the main transport path SP, of the image forming portion 30 when double-side printing is conducted with respect to the sheet.

The main transport path SP is provided to extend so as to upwardly pass the transfer nip portion formed with the photosensitive drum 31 and the transfer roller 34 from below. In the main transport path SP, on the side upstream of the transfer nip portion, a pair of resist rollers 19 are arranged. A sheet is once stopped by the pair of resist rollers 19 and after being subjected to skew correction, is sent to the transfer nip portion at predetermined timing for image transfer. At appropriate positions on the main transport path SP and the reverse transport path DP, a plurality of transport rollers for transporting a sheet are arranged, and for example, in proximity to the sheet ejection port 14, a pair of sheet ejection rollers 15 are arranged. The reverse transport path DP is formed at an inner side of the back cover 12 of the main body housing 10.

<As to Developing Device>

Figure 2:
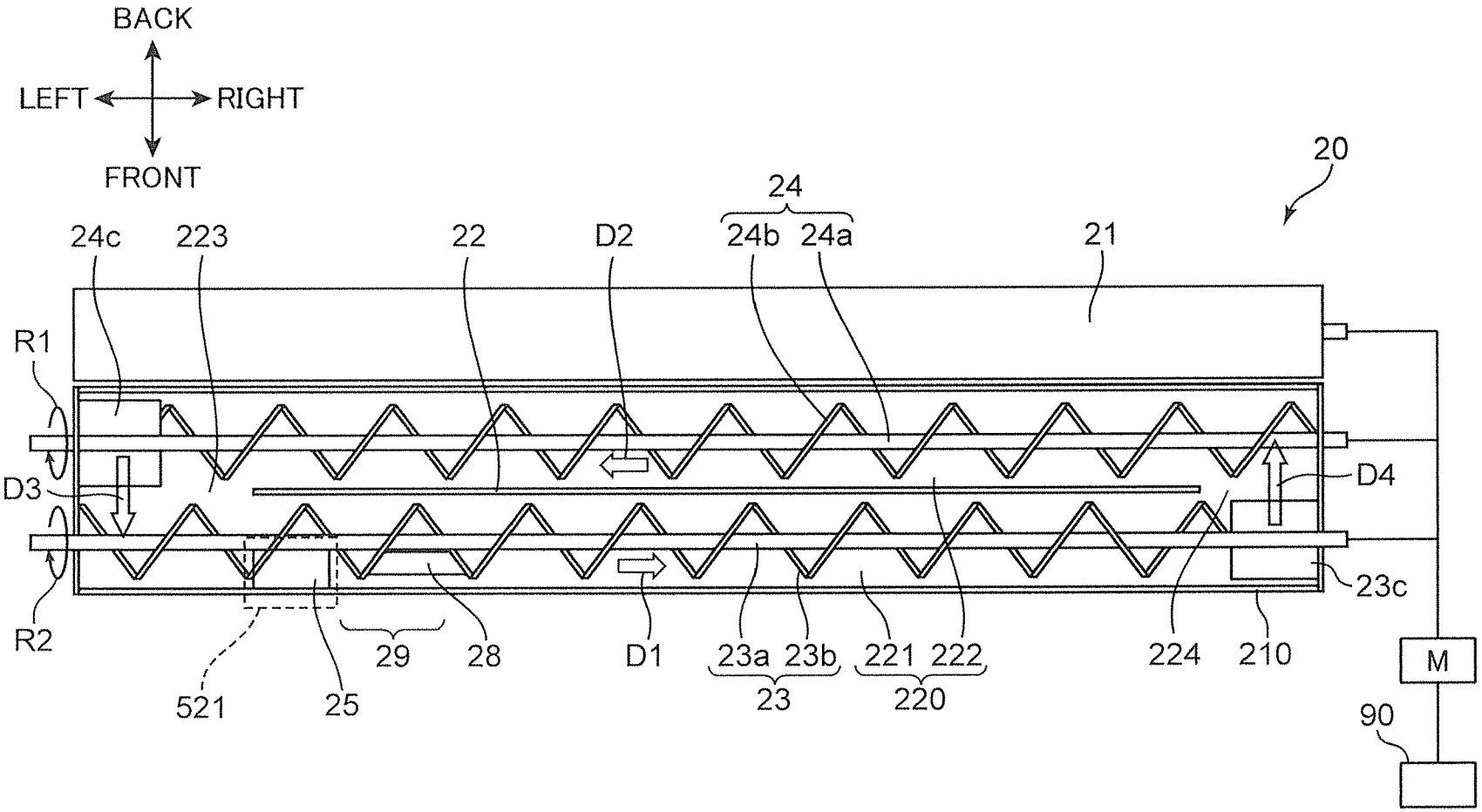
FIG. 2 is a schematic plan view showing an internal structure of a developing device according to one embodiment of the present disclosure.
Figure 3:
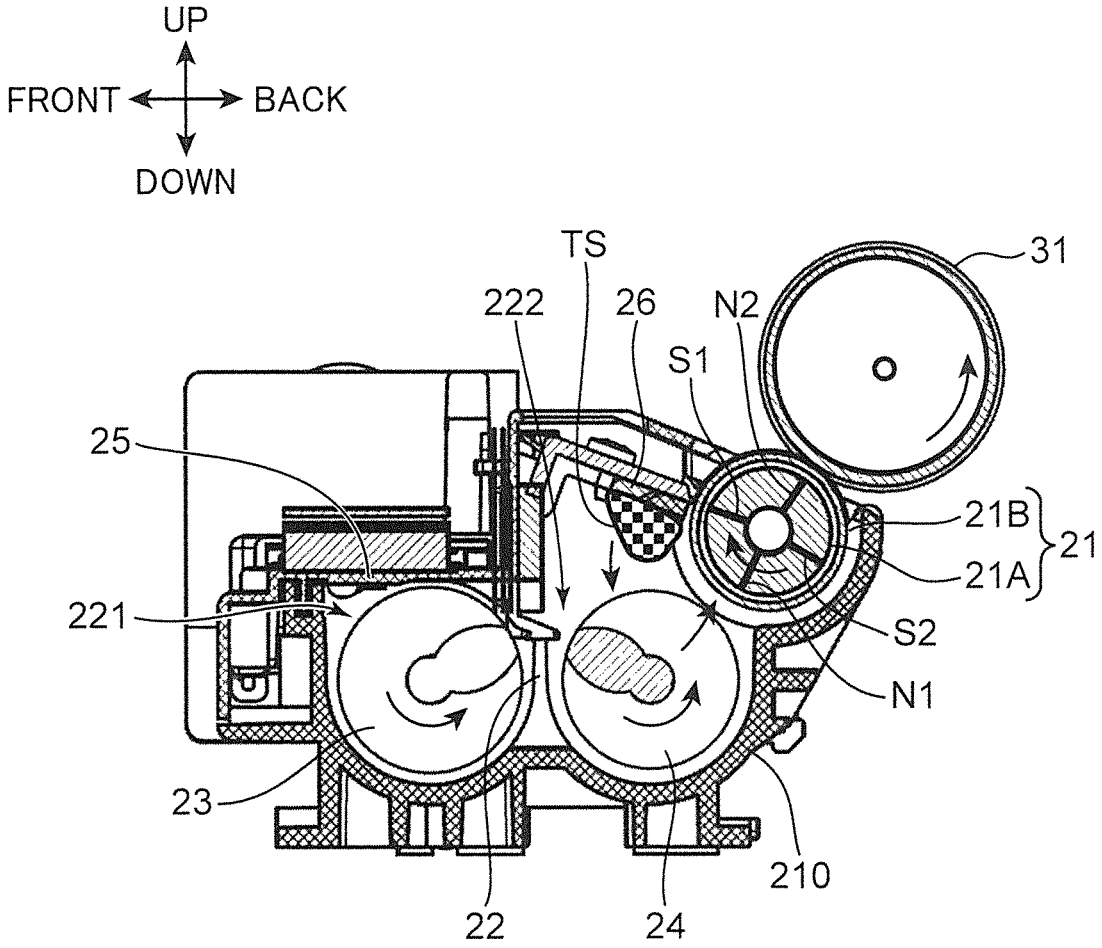
FIG. 3 is a sectional view showing the internal structure of the developing device according to one embodiment of the present disclosure.

FIG. 2 is a plan view showing an internal structure of the developing device 20. FIG. 3 is a sectional view of the developing device 20, which is a sectional view orthogonal to an axis direction of the developing roller 21. The developing device 20 includes a developing housing 210 having a box-shape long in one direction (the axis direction of the developing roller 21, a right and left direction). The developing housing 210 has a storage space 220. The developing housing 210 also has a toner replenishing port 25 opened. The developing device 20 further includes the developing roller 21, the first stirring screw 23 and the second stirring screw 24, and a regulation blade 26 (a layer thickness regulating member) which are arranged in the storage space 220. In the present embodiment, a magnetic one-component developing system is applied, in which the storage space 220 is filled with a one-component magnetic toner as a developer.

The developing roller 21 with a tubular shape is provided to extend in a longitudinal direction of the developing housing 210. The developing roller 21 includes a fixed magnet 21A and a sleeve 21B (FIG. 3). The fixed magnet 21A is a tubular magnet fixed to the developing housing 210. The sleeve 21B is supported in the developing housing 210 so as to be rotatable around the fixed magnet 21A. The fixed magnet 21A includes four magnetic poles along a rotation direction (circumferential direction) of the sleeve 21B. Table 1 shows an example showing magnetic forces (a magnetic flux density at a peak position) and positions of the four magnetic poles of the fixed magnet 21A.

TABLE 1

| Magnetic pole | Magnetic force | Angle (counterclockwise) from position opposed to regulation blade |
|---|---|---|
| S1 (Regulation pole) | 80 mT | 4° |
| N1 (Drawing-up pole) | 40 mT | 96° |
| S2 (Transport pole) | 84 mT | 180° |
| N2 (Main pole) | 88 mT | 255° |

An S1 pole is arranged to be opposed to the regulation blade 26 and functions as a regulation pole which regulates an amount of a toner (an amount of a developer) to be carried on the developing roller 21 (the sleeve 21B). An N1 pole is arranged to be opposed to the second stirring screw 24 and functions as a drawing-up pole which receives a toner drawn up by the second stirring screw 24. An S2 pole functions as a transport pole which transports a toner for collecting a toner into the developing housing 210, the toner having passed through a developing position at which the developing roller 21 and the photosensitive drum 31 are opposed to each other. An N2 pole is arranged to be opposed to the photosensitive drum 31 and functions as a main pole which forms a magnetic brush at the developing position for supplying a toner to the photosensitive drum 31.

The storage space 220 of the developing housing 210 is covered by a top (not shown) and is also sectioned, into a first transport path 221 and a second transport path 222 which are long in the right and left direction, by a partition plate 22 extending in the right and left direction. The first transport path 221 is a transport path which is arranged at an interval from the developing roller 21 and in which a toner is transported in a first direction (D1) along the axis direction of the developing roller 21. On the other hand, the second transport path 222 is a transport path which is arranged between the developing roller 21 and the first transport path 221 and in which a toner is transported in a second direction (D2) opposite to the first direction. The partition plate 22 is shorter than a width of the developing housing 210 in the right and left direction and has a first communication path 223 and a second communication path 224 provided at left end and right end of the partition plate 22 for respectively making the first transport path 221 and the second transport path 222 communicate. In this manner, a circular path is formed in the storage space 220 from the first transport path 221 through the second communication path 224 and the second transport path 222 to reach the first communication path 223. The toner is transported counterclockwise in the circular path in FIG. 2.

The toner replenishing port 25 (a developer replenishing port) is an opening portion which is opened in the top of the developing housing 210, and arranged below the toner discharge port 521 of the toner container 50 (FIG. 2) and above a left end side of the first transport path 221. The toner replenishing port 25 is arranged to be opposed to the above circular path and has a function of receiving a replenishment toner (replenishment developer) replenished from the toner discharge port 521 into the storage space 220.

The first stirring screw 23 is rotatably disposed in the first transport path 221. The first stirring screw 23 includes a first rotation shaft 23*a*, and a first spiral vane 23*b* provided to project in a spiral manner on a circumference of the first rotation shaft 23*a*. The first stirring screw 23 transports a toner in a direction of an arrow D1 in FIG. 2 as a result of being rotatably driven around the first rotation shaft 23*a* (an arrow R2). On the downstream side in the toner transport direction (D1 direction) of the first stirring screw 23, a first paddle 23*c* is disposed. The first paddle 23*c* transmits a toner from the first transport path 221 to the second transport path 222 toward a direction of an arrow D4 in FIG. 2. The developing roller 21 is located obliquely above the second stirring screw 24. The photosensitive drum 31, the developing roller 21, and the second stirring screw 24 are arranged on a generally straight line as shown in FIG. 3.

The second stirring screw 24 is rotatably disposed in the second transport path 222 so as to be opposed to the first stirring screw 23 in a horizontal direction. The second stirring screw 24 includes a second rotation shaft 24*a*, and a second spiral vane 24*b* provided to project in a spiral manner on a circumference of the second rotation shaft 24*a*. The second stirring screw 24 supplies a toner to the developing roller 21 while transporting a toner in a direction of an arrow D2 in FIG. 2 as a result of being rotatably driven around the second rotation shaft 24*a* (an arrow R1). On the downstream side in the toner transport direction (D2 direction) of the second stirring screw 24, a second paddle 24*c* is disposed. The second paddle 24*c* transmits a toner from the second transport path 222 to the first transport path 221 toward a direction of an arrow D3 in FIG. 2.

The regulation blade 26 is supported in the developing housing 210 so as to extend toward the circumference surface (the sleeve 21B) of the developing roller 21, as well as being opposed to the developing roller 21 as shown in FIG. 3. The regulation blade 26 regulates a layer thickness of a toner supplied from the second stirring screw 24 to the developing roller 21. A predetermined gap (e.g. 0.2 to 0.4 mm) is formed between a front end of the regulation blade 26 and the sleeve 21B. In the present embodiment, the regulation blade 26 slants to a forward direction toward the developing roller 21 with respect to a horizontal plane. Also, the regulation blade 26 extends along the axis direction such that a toner carrying region is included on the sleeve 21B of the developing roller 21. The regulation blade 26 is configured by fixing a magnetic member to a plate made of a nonmagnetic metal material.

The toner container 50 (FIG. 1) is arranged above the toner replenishing port 25 of the developing housing 210. The toner container 50 includes the above-described toner discharge port 521 (FIG. 2). The toner discharge port 521 is disposed in the cylindrical portion 52 of the toner container 50 so as to correspond to the toner replenishing port 25 of the developing device 20 (FIG. 1). The toner falling down from the toner discharge port 521 is replenished from the toner replenishing port 25 to the developing device 20.

Further, the developing device 20 includes a driving portion M and the control portion 90 (FIG. 2). The driving portion M is configured with a motor and a group of gears, which are not shown. In the present embodiment, the motor of the driving portion M is rotatable in forward and backward directions. As a result, the driving portion M generates a driving force which enables the developing roller 21, the first stirring screw 23, and the second stirring screw 24 to rotate around a predetermined axis in a first rotation direction and a second rotation direction opposite to the first rotation direction. Additionally, the group of gears of the driving portion M is rotatably supported in the developing housing 210 to transmit a rotation driving force generated by the motor to the developing roller 21, the first stirring screw 23, and the second stirring screw 24 in synchronization with each other. At the time of image formation, in which an image is formed on a sheet in the image forming device 1, in other words, at the time of developing operation in which an electrostatic latent image on the photosensitive drum 31 is made to appear by the developing device 20, the photosensitive drum 31, the developing roller 21, the first stirring screw 23, and the second stirring screw 24 are respectively rotated in the arrows shown in FIG. 3. Specifically, the first stirring screw 23 upwardly rotates in a region opposed to the partition plate 22 from below, and the second stirring screw 24 downwardly rotates in a region opposed to the partition plate 22 from above. The developing roller 21 and the second stirring screw 24 rotate in regions opposed to each other in the same direction. The regulation blade 26 is located above a region in which the developing roller 21 and the second stirring screw 24 are opposed to each other.

The control portion 90 controls the driving portion M at predetermined timing at the time of image formation, thereby rotatably driving the developing roller 21, the first stirring screw 23, and the second stirring screw 24. At the time of reverse rotation control to be described later, the control portion 90 causes the developing roller 21, the first stirring screw 23, and the second stirring screw 24 to rotate in a direction opposite to the arrows in FIG. 3 by reversely rotating the motor of the driving portion M. The control portion 90 also controls operation and rotation of other members in the image forming device 1 including the photosensitive drum 31.

<As to Replenishment of Toner>

Figure 4:
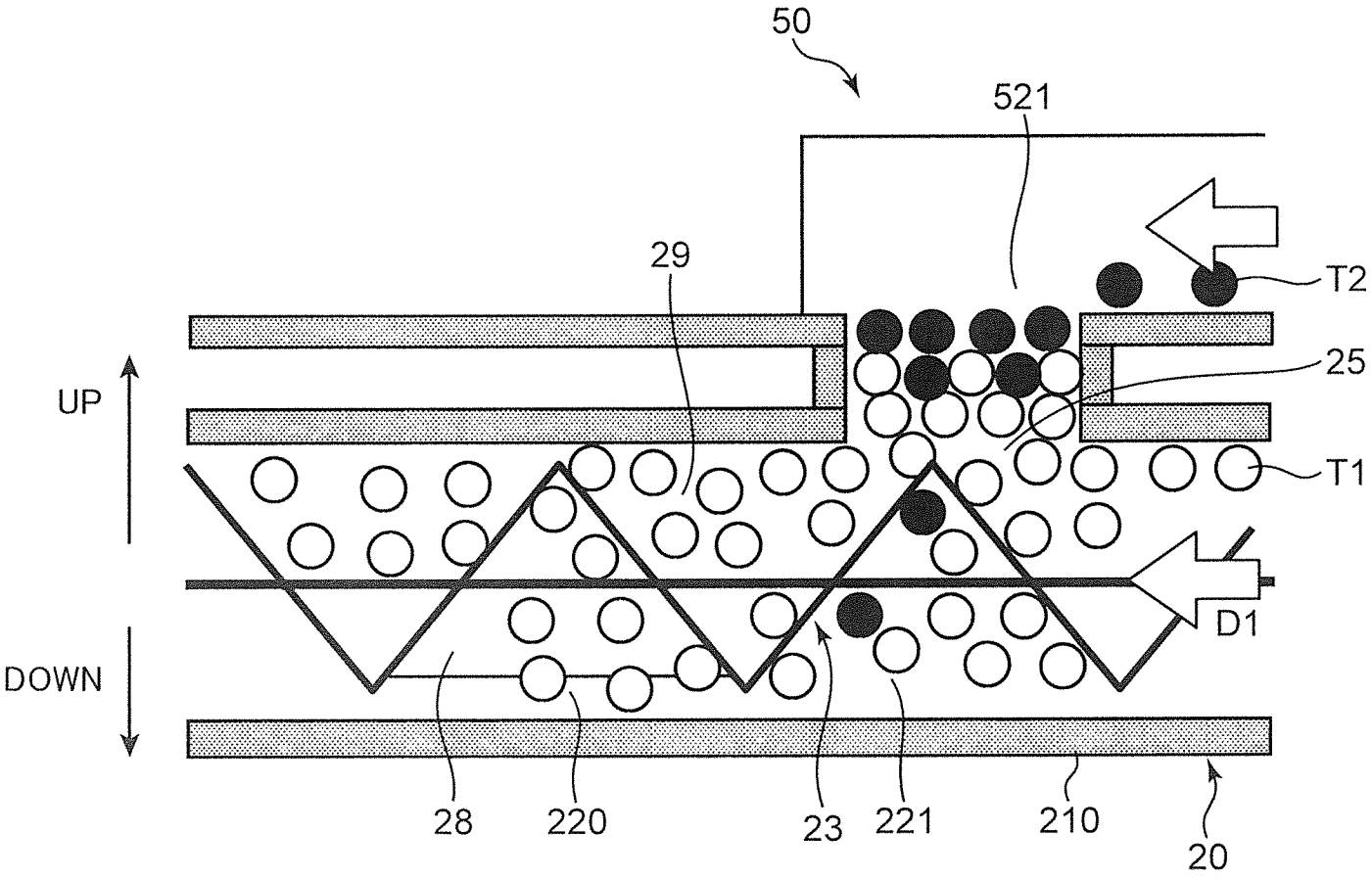
FIG. 4 is a schematic sectional view showing how the developing device according to one embodiment of the present disclosure is replenished with a developer.

Next, description will be made of a flow of a toner to be newly replenished from the toner replenishing port 25. FIG. 4 is a sectional view in proximity to the toner replenishing port 25 disposed in the developing device 20 and the toner discharge port 521 disposed in the toner container 50.

A replenishment toner T2 supplied from the toner discharge port 521 of the toner container 50 falls down to the first transport path 221 to be mixed with an existing toner T1 and transported by the first stirring screw 23 in the arrow D1 direction. At this time, the toners T1 and T2 are stirred to be charged.

The first stirring screw 23 includes, at a downstream side of the toner replenishing port 25 in the toner transport direction (the first direction), a suppression paddle 28 (a transport capacity suppressing portion) which partly suppresses a developer transportation performance. In the present embodiment, the suppression paddle 28 is a plate-like member arranged between the adjacent first spiral vanes 23*b* of the first stirring screw 23. Rotation of the suppression paddle 28 around the first rotation shaft 23*a* causes a toner transported from the side upstream of the suppression paddle 28 to start retention. Then, the retention of the toner is accumulated to a position which is immediately upstream of the suppression paddle 28 and at which the toner replenishing port 25 is opposed to the first transport path 221. As a result, near an entrance of the toner replenishing port 25, a retention part 29 of a developer (a developer retention part) is formed. In other embodiment, the transport capacity suppressing portion may be formed by a region obtained as a partly missing part of the first spiral vane 23*b* of the first stirring screw 23, in which region the first rotation shaft 23*a* is partly exposed along the axis direction. Also in such a configuration, a transport capacity of the first stirring screw 23 is partly suppressed, resulting in forming a developer retention part.

When the replenishment toner T2 is replenished from the toner replenishing port 25 to increase an amount of a toner in the storage space 220, retention of the toner in the retention part 29 blocks the toner replenishing port 25 (seal) to suppress further replenishment of a toner. Thereafter, when the toner in the storage space 220 is consumed from the developing roller 21 to reduce toner retention in the retention part 29, the amount of the toner blocking the toner replenishing port 25 is reduced to generate a gap between the retention part 29 and the toner replenishing port 25. As a result, the replenishment toner T2 again flows into the storage space 220 from the toner replenishing port 25. Thus, the present embodiment adopts a volume supply type toner replenishment mode in which an amount of a replenishment toner to be received is adjusted as the toner retention in the retention part 29 is reduced.

Figure 5:
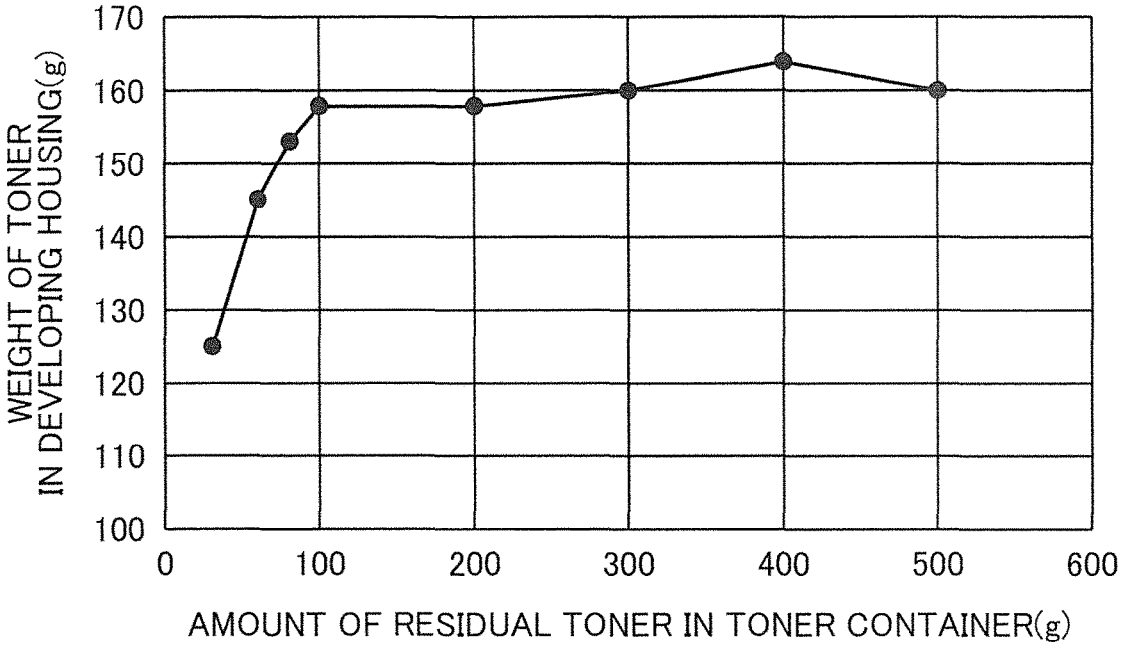
FIG. 5 is a graph showing a relationship between an amount of a residual developer in a developer container and an amount of a developer in the developing device.

FIG. 5 is a graph showing a relationship between an amount of a residual developer in the toner container 50 and an amount of a developer in the developing device 20. As one example, a new toner container 50 is filled with 500 g of toner. In this state, when image formation operation is executed in the image forming device 1, as the developing device 20 consumes a toner, a toner is replenished from the toner container 50 to the developing device 20 according to the above volume supply type toner replenishment mode. During reduction in an amount of a toner in the toner container 50 from 500 g to 100 g, the amount of the developer in the developing device 20 becomes around 160 g. In this case, a sufficient toner is drawn up from the second stirring screw 24 to the developing roller 21. The toner supplied to the developing roller 21 is transported toward the regulation blade 26 as the sleeve 21B rotates. Then, the toner having passed through the gap between the regulation blade 26 and the sleeve 21B is transported toward the developing position and is supplied to the photosensitive drum 31 as required.

On the other hand, the toner regulated by the regulation blade 26 is retained in a lower surface portion (a back surface portion) of the regulation blade 26 by a magnetic field formed by the S1 pole (FIG. 3) and the regulation blade 26 (a regulated retention part TS). Here, since the magnetic field formed by the S1 pole is limited, a toner overflowing from the regulated retention part TS in due time falls downward as indicated by the arrow in FIG. 3. Accordingly, since replacement of a toner is stably conducted in the regulated retention part TS, toner aggregate is less liable to be generated.

With reference to FIG. 5, when an amount of a toner in the toner container 50 falls below 100 g, approximately in proportion to an amount of residual toner in the toner container 50, the amount of a developer in the developing device 20 is reduced. This is because even though a gap is formed between the retention part 29 (FIG. 4) and the toner replenishing port 25 in the developing device 20, a sufficient toner does not flow into the developing device 20. In this case, the amount of a toner drawn up from the second stirring screw 24 into the developing roller 21 is also reduced. As a result, replacement of a toner in the regulated retention part TS in FIG. 3 is not sufficiently conducted, so that the toner is liable to be aggregated in the regulated retention part TS. In particular, since a pressure of the toner to be upwardly transported from below by the sleeve 21B is applied to the lower surface portion of the regulation blade 26, a large stress is applied to the toner around the lower surface portion to cause toner aggregation. Such an aggregate of a toner is drawn up onto the developing roller 21 by the second stirring screw 24 after falling down from the regulated retention part TS due to vibration caused at the time of spin-up of rotation of the developing roller 21 and the like. However, since the aggregate is not allowed to pass through a gap between the regulation blade 26 and the sleeve 21B, the aggregate stays in the gap. As a result, in a toner layer having passed the regulation blade 26, a part with a small layer thickness is formed corresponding to a position of the aggregate. This leads to generation of a low density streak (white streak) in an image.

In order to solve such a problem, in the volume supply type developing device 20, the control portion 90 (drive control portion) causes the developing roller 21 to reversely rotate for a predetermined time according to an output of the toner container 50S in the present embodiment. In other words, at the time of the developing operation in which an electrostatic latent image on the photosensitive drum 31 is made to appear by a toner on the developing roller 21, the control portion 90 causes the developing roller 21 to rotate in the first rotation direction, and when the toner sensor 50S senses that a residual amount of a toner in the toner container 50 falls below a predetermined threshold value, causes the developing roller 21 to rotate in the second rotation direction at predetermined timing different from that of the developing operation.

As a result, the toner in the regulated retention part TS falls down upon receiving rotary power of the sleeve 21B, or moves within the regulated retention part TS. Therefore, when the control portion 90 next causes the sleeve 21B to rotate in a forward direction, the toner in the regulated retention part TS is replaced. As a result, generation of a toner aggregate is suppressed in the regulated retention part TS. This prevents the aggregate between the regulation blade 26 and the developing roller 21 from clogging to suppress generation of streaked image failure.

Further, also in a period before the toner sensor 50S senses a residual amount of a toner in the toner container 50 falling below the threshold value, the control portion 90 may cause the developing roller 21 to rotate in the second rotation direction at predetermined timing. In this case, since the developing roller 21 is reversely rotated even when a residual amount of a toner in the toner container 50 is sufficient, replacement in the regulated retention part TS is always accelerated to further suppress generation of a streaked image failure.

Additionally, the control portion 90 preferably causes the developing roller 21 to rotate in the second rotation direction at the time of non-image-formation operation different from the image formation operation in which a toner image is transferred to a sheet. In this case, the developing roller 21 can be rotated in the second rotation direction without affecting the image formation operation. Further, as non-image-formation operation, the developing roller 21 is preferably rotated in the second rotation direction in periods before and after the image formation operation, or a period corresponding to an interval between sheets when images are successively formed on a plurality of sheets. In this case, the developing roller 21 can be rotated in the second rotation direction without considerably reducing productivity in the image formation operation.

Additionally, in the reverse rotation control of the developing roller 21 according to the present embodiment, the sleeve 21B is desirably rotated reversely within a range of one rotation or less (rotation angle). In this case, a toner retained on the back surface (regulated retention part TS) of the regulation blade 26 can be moved without considerably losing a toner layer on the developing roller 21.

EXAMPLES

Next, effects of the present disclosure will be described in further detail through Examples. The present disclosure is not limited to the following Examples. Experiment 1 and Experiment 2 to be described later were conducted under the following common experiment conditions and experiment method.

<Common Experiment Conditions> diameter of the photosensitive drum 31: 30 mm linear speed (process speed) of the photosensitive drum 31: 140 mm/sec diameter of the developing roller 21: 20 mm linear speed (peripheral speed) of the developing roller 21: 224.72 mm/sec the regulation blade 26: product of SUS430 peak magnetic flux density of the regulation pole (the S1 pole): 80 mT interval (blade gap) between the regulation blade 26 and the developing roller 21: 300 μm diameters of the first stirring screw 23 and the second stirring screw 24: 22.5 mm the number of rotations of the first stirring screw 23 and the second stirring screw 24: 23 rpm rotation angle of the developing roller 21 at the time of the reverse rotation control: 30 degrees toner: magnetic one-component toner, volume-average particle size 6.8 μm, made of polyester resin experiment environment: 28° C., 80% RH
print pattern: image density 4%, character chart
the residual toner amount sensing portion: a magnetic permeability sensor (the toner sensor 50S)

<Common Experiment Method>

Image printing was conducted until a residual amount of a toner of 500 g in the toner container 50 becomes 80 g to obtain a state where an amount of a toner in the developing device 20 is reduced along with a residual amount of a toner in the toner container 50. In this state, a half tone image for visual check of a toner layer on the sleeve 21B and image evaluation was output for level check of a toner aggregate streak. Determination criteria of a toner aggregate streak are as follows, in which 3 or above was evaluated as a passing level.

5: a toner layer on the sleeve 21B is uniform and no streak is generated in an image.

4: a level on which a slight vertical streak is generated on the sleeve 21B but does not appear on an image.

3: a level on which a vertical streak is generated on a sleeve, the streak being slightly recognized in an image, the level with no problem in practical use.

2: a vertical streak was generated on the sleeve 21B, the vertical streak being generated of a level on which a streak can be recognized in an image as well.

1: a state where a vertical streak is generated on the sleeve 21B, and a toner aggregate is clogged between the regulation blade 26 and the developing roller 21 (blade gap). An image also has a white streak formed.

<Experiment 1>

Each condition of Experiment 1 and evaluation results are shown in Table 2. In the reverse rotation control of the developing roller 21, "normal" represents execution irrespective of a residual amount of a toner in the toner container 50, "after reduction in residual amount of toner" represents execution when the toner sensor 50S determines that a residual amount of a toner in the toner container 50 is small (80 g or less). This is also the case with Experiment 2.

TABLE 2

| | Reverse rotation | | Toner aggregate streak level | |
|---|---|---|---|---|
| | Normal | After reduction in residual amount of toner | Normal | After reduction in residual amount of toner |
| Example 1 | None | Once in 30 seconds | 4 | 5 |
| Example 2 | None | Once in 1 minute | 4 | 4 |
| Example 3 | None | Once in 3 minutes | 4 | 3 |
| Comparative Example 1 | None | None | 4 | 1 |

In Comparative Example 1, since the reverse rotation control of the developing roller 21 was not conducted, toner replacement was not sufficiently conducted on the back of the regulation blade 26, so that a vertical streak was generated due to an aggregate of a toner on the sleeve 21B, and a vertical streak was generated on a level that can be recognized in an evaluation image. In Example 1, as a result of printing while reversely rotating the sleeve 21B by a rotation angle of 30 degrees in a direction reverse to that of the image formation at the timing of once in 30 seconds of the developing driving time, the toner layer on the sleeve 21B was uniform and no streak was generated by an aggregate of a toner on the evaluation image. In Example 2, since frequency of reverse rotation was reduced as compared with Example 1, a vertical streak of a slight level was confirmed on the sleeve 21B, on which level, no streak appeared on the evaluation image at all. In Example 3, since the frequency of reverse rotation was further reduced, while a vertical streak was confirmed on the sleeve 21B, which was of a level where a streak was slightly recognized in an evaluation image, the level having no problem in practical use.

As described in the foregoing, when a residual amount of a toner in the toner container 50 became smaller than a predetermined threshold value, by executing the reverse rotation control of the developing roller 21 at a predetermined interval, generation of a toner aggregate streak, generated immediately before replacement of the toner container 50, could be suppressed. By limiting execution of the reverse rotation control to immediately before replacement of the toner container 50, reduction in productivity of the image forming device 1 due to interruption of the reverse rotation control can be suppressed to be minimum.

<Experiment 2>

Each condition of Experiment 2 and evaluation results are shown in Table 3.

TABLE 3

| | Reverse rotation | | Toner aggregate streak level | |
|---|---|---|---|---|
| | Normal | After reduction in residual amount of toner | Normal | After reduction in residual amount of toner |
| Example 4 | Once in 3 minutes | Once in 30 seconds | 5 | 5 |
| Example 5 | Once in 3 minutes | Once in 1 minute | 5 | 4 |
| Example 6 | Once in 3 minutes | Once in 3 minutes | 5 | 3 |
| Example 7 | Once in 30 seconds | Once in 30 seconds | 5 | 5 |
| Comparative Example 2 | Once in 3 minutes | None | 5 | 1 |

In Example 4 to Example 7, conducting the reverse rotation control of the developing roller 21 at a predetermined interval irrespective of a residual amount of a toner in the toner container 50 resulted in having a more excellent level of a toner aggregate streak in a period when the toner container 50 had a sufficient residual amount of a toner than in the previous Example 1 to Example 3. On the other hand, in Comparative Example 2, although the reverse rotation control of the developing roller 21 in normal execution was conducted, no execution of the reverse rotation control at the time when the residual amount of a toner becomes small causes insufficient replacement of a toner on the back of the regulation blade 26, so that clogging of the aggregate toner was confirmed in a blade gap to generate a void in an image. By executing the reverse rotation control of the developing roller 21 irrespective of a residual amount of a toner in the toner container 50 in this manner, high image quality can be continuously maintained. On the other hand, since the image formation operation should be temporarily interrupted or an interval between sheets should be long for the reverse rotation control of the developing roller 21, executing the reverse rotation control of the developing roller 21 only after a residual amount of a toner in the toner container 50 becomes small enables image quality to be maintained without greatly affecting productivity of the image forming device 1.

In the foregoing, the image forming device 1 according to the embodiment of the present disclosure has been described. In the present embodiment, even when reduction in a residual amount of a toner in the toner container 50 in the volume supply type developing device 20 makes a toner retained on the back surface of the regulation blade 26 be liable to aggregate, the developing roller 21 is reversely rotated at predetermined timing. As a result, an aggregate is prevented from clogging between the regulation blade 26 and the developing roller 21, thereby suppressing generation of a streaked image failure. On the other hand, the present disclosure is not limited thereto and a modified embodiment such as follows can be adopted.

(1) While in the above embodiment, the residual amount sensing portion according to the present disclosure has been described using the toner sensor 50S provided in the toner container 50, the present disclosure is not limited thereto. The control portion 90 may sense (estimate) a residual amount of a toner in the toner container 50 becoming small when a total driving time of the rotation member 54 after attachment of a new toner container 50 exceeds a predetermined threshold value, or when a total printing ratio in the image forming device 1 after attachment of a new toner container 50 exceeds a predetermined threshold value, or when an image density (patch density) sensed by a density sensor (not shown) falls below a predetermined threshold value. In this case, the control portion 90 desirably includes a residual developer amount estimate portion (not shown).

(2) Although the above embodiment has been described with respect to the configuration in which the driving portion M causes the developing roller 21, the first stirring screw 23, and the second stirring screw 24 to rotate in the forward rotation direction and the backward rotation direction in association with each other, the present disclosure is not limited thereto. The developing device 20 may be configured to include a first driving portion which rotatably drives the developing roller 21 and a second driving portion which rotatably drives the first stirring screw 23 and the second stirring screw 24. Alternatively, the driving portion M may include a rotation direction regulation member such as a one-way clutch on a driving channel linked to the first stirring screw 23 and the second stirring screw 24. In either case, at the time of the reverse rotation control of the developing roller 21, reverse rotation of the first stirring screw 23 and the second stirring screw 24 may be regulated, i.e., rotation of the first stirring screw 23 and the second stirring screw 24 may be stopped.

As described above, the first stirring screw 23 includes the suppression paddle 28, so that as the first stirring screw 23 rotates, the retention part 29 of a developer is formed. The retention part 29 functions to control replenishment of a toner from the toner container 50 to the developing device 20. When the first stirring screw 23 is reversely rotated at the reverse rotation operation of the developing roller 21, however, the retention part 29 formed around the toner replenishing port 25 breaks down, so that a toner flows in a direction opposite to the first direction D1. In this case, at the start of next printing operation, inflow of unnecessary replenishment toner might occur. Therefore, as described above, preventing reverse rotation of at least the first stirring screw 23 at the time of reverse rotation operation of the developing roller 21 suppresses the retention part 29 of a toner from breaking down. As a result, volume supply type toner replenishment can be stably realized, while suppressing a toner aggregate and generation of a streak image around the regulation blade 26, which phenomena are caused as a residual amount of a toner in the toner container 50 is reduced.

Further, the above one-way clutch may function only with respect to the first stirring screw 23, while at the time of the reverse rotation control of the developing roller 21, the second stirring screw 24 may be rotated in the forward rotation direction (the same rotation direction as the rotation direction of the second stirring screw 24 when the developing roller 21 is rotated in the first rotation direction). Also in this case, the retention part 29 of a toner being formed by the suppression paddle 28 is suppressed from breaking down while the developing roller 21 is reversely rotated.

(3) As shown in FIG. 3, the developing roller 21 is located obliquely above the second stirring screw 24, and the regulation blade 26 is arranged above the second stirring screw 24 so as to be opposed to the developing roller 21. The second stirring screw 24 rotates so as to upwardly move in a region closer to the developing roller 21 in the horizontal direction from below at the time of the developing operation. In this state, when the developing roller 21 is rotated in a direction opposite to the arrow in FIG. 3, a part of the toner in the regulated retention part TS falls down. At this time, when the second stirring screw 24 is rotated in the rotation direction of the arrow (the forward rotation direction) in FIG. 3, the fallen toner is temporarily transported to the partition plate 22 side. In other words, the fallen toner is suppressed from again attaching to the developing roller 21. As a result, a toner present in the regulated retention part TS and in short of a charged amount is suppressed from moving to the photosensitive drum 31 side and from causing an image failure such as toner overlapping or a color point. Such effect is exhibited even if rotation of the second stirring screw 24 is stopped at the time of reverse rotation of the developing roller 21. In this case, the fallen toner is temporarily transported to the partition plate 22 side upon start of subsequent rotation of the second stirring screw 24.

(4) The control portion 90 may increase frequency of rotation of the developing roller 21 in the second rotation direction as a residual amount of a toner in the toner container 50 becomes less. In this case, clogging between the regulation blade 26 and the developing roller 21 is prevented to further suppress generation of a streaked image failure.

(5) Additionally, although in the above embodiment, the transfer portion has been described using the transfer roller 34, the transfer portion may include a well-known intermediate transfer unit, etc.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming device comprising:

a developer container which houses a developer therein and has a developer discharge port capable of discharging the developer;

a developing device which has a developing roller configured to be rotatable and carrying a developer on a circumference surface of the developing roller, and which receives the developer from the developer container;

a photosensitive drum which has a surface on which an electrostatic latent image is formed, and which carries a developer image made to appear from the electrostatic latent image by the developer on the developing roller;

a transfer portion which transfers the developer image on the photosensitive drum to a sheet;

a residual amount sensing portion which senses that a residual amount of a developer in the developer container falls below a predetermined threshold value;

a driving portion which generates a driving force to cause the developing roller to rotate around a predetermined axis in a first rotation direction and a second rotation direction opposite to the first rotation direction; and a drive control portion which controls the driving portion to rotatably drive the developing roller;

wherein the developing device includes:

a developing housing which rotatably supports the developing roller;

a developer transport path formed in the developing housing and including a first transport path which is arranged at an interval from the developing roller and in which the developer is transported in a first direction along an axis direction of the developing roller, and a second transport path which is arranged between the developing roller and the first transport path and in which the developer is transported in a second direction opposite to the first direction, the developer being circularly transported between the first transport path and the second transport path;

a developer replenishing port which is opened, in the housing, below the developer discharge port and above the first transport path, and which receives the developer from the developer container onto the developer transport path;

a first transport member rotatably arranged on the first transport path, and configured to transport the developer in the first direction;

a second transport member rotatably arranged on the second transport path, and configured to transport the developer in the second direction, and to supply the developer to the developing roller;

a transport capacity suppressing portion provided downstream of the developer replenishing port in the first direction to partly suppress a transport capacity of the developer in the first direction of the first transport member, thereby forming a developer retention part at a position opposed to the developer replenishing port; and a layer thickness regulating member arranged to be opposed to the developing roller to regulate a layer thickness of the developer supplied from the second transport member to the developing roller, and during developing operation in which the electrostatic latent image is made to appear by the developer on the developing roller, the drive control portion causes the developing roller to rotate in the first rotation direction and when the residual amount sensing portion senses that a residual amount of the developer in the developer container falls below the threshold value, causes the developing roller to rotate in the second rotation direction at a predetermined timing different from timing of the developing operation, and further wherein:

the control portion increases a frequency of rotation of the developing roller in the second rotation direction as the residual amount of the developer in the developer container becomes less.

2. The image forming device according to claim 1, wherein the drive control portion causes the developing roller to rotate in the second rotation direction at a predetermined timing also in a period before the residual amount sensing portion senses that the residual amount of the developer in the developer container falls below the threshold value.

3. The image forming device according to claim 1, wherein the drive control portion causes the developing roller to rotate in the second rotation direction during a non-image-formation operation different from image formation operation in which the developer image is transferred to the sheet.

4. The image forming device according to claim 3, wherein the time of the non-image-formation operation corresponds to periods before and after the image formation operation, or a period corresponding to an interval between sheets when images are successively formed on a plurality of sheets.

5. The image forming device according to claim 1, wherein the drive control portion causes the developing roller to rotate in the second rotation direction by a rotation angle corresponding to one rotation or less.

6. The image forming device according to claim 1, wherein the drive control portion causes the first transport member and the second transport member to stop rotating when causing the developing roller to rotate in the second rotation direction.

7. The image forming device according to claim 1, wherein when causing the developing roller to rotate in the second rotation direction, the drive control portion causes the first transport member and the second transport member to rotate in the same rotation directions as the rotation directions of the first transport member and the second transport member, respectively, when the developing roller is rotated in the first rotation direction.

8. The image forming device according to claim 1, wherein the developing roller is arranged at a position obliquely above the second transport member, the layer thickness regulating member is arranged above the second transport member so as to be opposed to the developing roller, and the second transport member rotates to upwardly move in a region closer to the developing roller in a horizontal direction from below during the developing operation.

* * * * *